US010473404B2

(12) United States Patent
Hsieh et al.

(10) Patent No.: US 10,473,404 B2
(45) Date of Patent: Nov. 12, 2019

(54) STRAIGHT-THROUGH STRUCTURE OF HEAT DISSIPATION UNIT

(71) Applicant: ASIA VITAL COMPONENTS CO., LTD., New Taipei (TW)

(72) Inventors: Kuo-Chun Hsieh, New Taipei (TW); Chih-Ming Chen, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 0 days.

(21) Appl. No.: 15/813,094

(22) Filed: Nov. 14, 2017

(65) Prior Publication Data

US 2019/0145712 A1 May 16, 2019

(51) Int. Cl.

| | |
|---|---|
| ***F28D 15/04*** | (2006.01) |
| ***F28D 15/02*** | (2006.01) |
| *F28D 21/00* | (2006.01) |

(52) U.S. Cl.

CPC ..... *F28D 15/0275* (2013.01); *F28D 15/0233* (2013.01); *F28D 15/04* (2013.01); *F28D 15/046* (2013.01); *F28D 15/0283* (2013.01); *F28D 2021/0028* (2013.01)

(58) Field of Classification Search

CPC ..... F28D 15/0233; F28D 15/0275; H01L 23/427; H05K 7/20336

USPC ..... 165/104.26, 104.33; 361/700

See application file for complete search history.

(56) References Cited

U.S. PATENT DOCUMENTS

| | | | | |
|---|---|---|---|---|
| 3,209,062 A * | 9/1965 | Scholz | H01L 23/427 | 165/104.21 |
| 6,269,866 B1 * | 8/2001 | Yamamoto | F28D 15/0233 | 165/104.26 |
| 6,302,192 B1 * | 10/2001 | Dussinger | F28D 15/0233 | 165/104.21 |
| 6,535,386 B2 * | 3/2003 | Sathe | H01L 23/4006 | 165/104.33 |

(Continued)

FOREIGN PATENT DOCUMENTS

| | | |
|---|---|---|
| CN | 1627032 A | 6/2005 |
| CN | 201697515 U | 1/2011 |

(Continued)

OTHER PUBLICATIONS

Machine Translation of CN 1627032A.*

*Primary Examiner* — Allen J Flanigan

(74) *Attorney, Agent, or Firm* — Thomas J. Nikolai; DeWitt LLP

(57) ABSTRACT

A straight-through structure of heat dissipation unit includes a first plate body and a second plate body correspondingly mated with each other to define a closed chamber. A hydrophilic layer is disposed on the surface of the closed chamber and a capillary structure is disposed in the closed chamber. The first plate body is formed with a first recess, a first perforation and a second recess. The first recess is connected with the capillary structure disposed on the third face of the second plate body. One end of the second recess abuts against the capillary structure. The capillary structure layer is not in contact with the first recess. The second plate body has a second perforation in alignment with the first perforation. When it is necessary to perforate the heat dissipation unit, the straight-through structure can keep the closed chamber in the vacuumed and airtight state.

6 Claims, 4 Drawing Sheets

(56) References Cited

U.S. PATENT DOCUMENTS

| | | | | |
|---|---|---|---|---|
| 6,650,544 | B1 * | 11/2003 | Lai | F28D 15/046 165/104.21 |
| 7,100,680 | B2 * | 9/2006 | Dussinger | F28D 15/0233 165/104.21 |
| 8,792,238 | B2 * | 7/2014 | Meyer, IV | F28D 15/0275 165/104.21 |
| 2003/0155105 | A1 * | 8/2003 | Garner | F28D 15/0233 165/104.26 |
| 2011/0315351 | A1 * | 12/2011 | Meyer, IV | F28D 15/046 165/104.26 |
| 2012/0168435 | A1 * | 7/2012 | Chen | F28D 15/0233 220/6 |
| 2015/0027668 | A1 * | 1/2015 | Yang | H05K 7/20336 165/104.26 |
| 2015/0060022 | A1 * | 3/2015 | Sun | F28D 15/04 165/104.26 |
| 2015/0083372 | A1 * | 3/2015 | Yang | F28D 15/02 165/104.26 |
| 2016/0123678 | A1 * | 5/2016 | Hulse | F28D 15/02 165/104.21 |

FOREIGN PATENT DOCUMENTS

| | | |
|---|---|---|
| CN | 105865241 A | 8/2016 |
| TW | 200936024 | 8/2009 |

* cited by examiner

STRAIGHT-THROUGH STRUCTURE OF HEAT DISSIPATION UNIT

BACKGROUND OF THE INVENTION

1. Field of the Invention

The present invention relates generally to a straight-through structure of heat dissipation unit, and more particularly to a straight-through structure of heat dissipation unit, which ensures that the closed chamber of the heat dissipation unit in a vacuumed and airtight state after the heat dissipation unit is perforated.

2. Description of the Related Art

Along with the enhancement of performance of the current electronic apparatus, the electronic components of the electronic apparatus for processing signals and operation will generate higher heat than before. The most often used heat dissipation components include heat pipe, heat sink, vapor chamber, etc. The heat dissipation component is in direct contact with the heat generation electronic component to enhance the heat dissipation efficiency so as to avoid burnout of the electronic component due to overheating.

The vapor chamber is applied to large-area face-to-face heat conduction and is different from the heat pipe for point-to-point heat conduction. The vapor chamber can be used in a narrow space.

Conventionally, the vapor chamber is used in combination with a substrate. The vapor chamber serves to conduct the heat of the substrate that is generated by a heat generation component. In the conventional technique, the sections of the vapor chamber that avoid the chamber are formed with perforations. That is, each of the four corners of the vapor chamber outside the closed chamber is formed with a perforation for passing through a copper column with an inner thread. The substrate is formed with at least one perforation in a position where the copper column is disposed. A threaded member is screwed through the copper column and the perforation to fix the vapor chamber on the substrate. However, according to such fixing manner, the copper columns are disposed on the four corners of the vapor chamber and distal from the heat generation component so that after the vapor chamber is fixed, the vapor chamber can be hardly tightly attached to the heat generation component. This will lead to thermal resistance. In order to improve the above problem that the vapor chamber can be hardly tightly attached to the heat generation component, some manufacturers directly dispose the copper columns in a position in adjacency to the section of the vapor chamber that is attached to the heat generation component. Therefore, the copper columns will directly penetrate through the sections of the vapor chamber with the closed chamber. When assembled, the tightness can be enhanced to avoid thermal resistance. However, after the copper columns penetrate through the closed chamber of the vapor chamber, the closed chamber is damaged to lose its airtightness. Under such circumstance, the interior of the chamber is no longer in a vacuumed state. Moreover, after the copper columns penetrate through and damage the chamber, the flowing path of the working fluid contained in the chamber may be interrupted to decrease the heat transfer efficiency. In some more serious cases, the working fluid may leak out to make the vapor chamber lose its heat transfer effect.

The conventional vapor chamber perforation structure is only applicable to a thicker vapor chamber, while being inapplicable to an ultra-thin vapor chamber. This is because the total thickness of the ultra-thin vapor chamber is only under 0.8 mm and it is impossible to additionally place any support column in the ultra-thin vapor chamber. In case the copper columns are used, the copper columns must have extremely thin thickness. Under such circumstance, it is hard to place in the copper columns and locate the copper columns. Moreover, the copper columns are too small to process. After the conventional vapor chamber is punched and perforated, the recessed section is connected with the lower plate. The connection sections are free from the capillary structure. This will affect the heat transfer performance of the vapor chamber. Therefore, with respect to a thick vapor chamber, the capillary structure must be also disposed on the sidewalls of the recessed section of the upper cover. The capillary structure of the sidewalls of the recessed section of the upper cover of the vapor chamber communicates with the capillary structure of the lower plate. Accordingly, as a whole, the structure of the conventional thick vapor chamber is inapplicable to the thin vapor chamber.

In addition, some manufacturers make ultra-thin vapor chamber by means of etching. By means of etching processing, the material of the plate body is partially removed to form channels or supporting structures. In this case, the plate body itself must have a considerable thickness so that after the material is removed, a sufficient thickness of material can be reserved. Furthermore, the sections with some material removed often have poor structural strength. Therefore, there are still some problems existing in the etching processing of the ultra-thin vapor chamber.

SUMMARY OF THE INVENTION

It is therefore a primary object of the present invention to provide a straight-through structure of heat dissipation unit, which can solve the problem of the conventional heat dissipation unit that after perforated, the closed chamber is damaged and no longer in a vacuumed and airtight state and the working fluid may leak out.

To achieve the above and other objects, the straight-through structure of heat dissipation unit of the present invention includes a first plate body and a second plate body.

The first plate body has a first face, a second face, a first recess, a first perforation and a second recess. The first and second recesses are recessed from the second face toward the first face. The first perforation is disposed through the first recess between the first and second faces.

The second plate body has a third face, a fourth face and a second perforation. The third face is correspondingly mated with the first face, whereby the first and second plate bodies together define a closed chamber. The second perforation is formed through the second plate body between the third and fourth faces in alignment with the first perforation.

A hydrophilic layer is disposed on the surface of the first face of the first plate body. A capillary structure layer is disposed on the third face of the second plate body in the closed chamber. One end of the second recess abuts against the capillary structure layer. The capillary structure layer is not in contact with the first recess.

When it is necessary to perforate the heat dissipation unit, the straight-through structure of the heat dissipation unit of the present to invention ensures that the closed chamber keeps in a vacuumed and airtight state. The straight-through structure is applicable to any kind of vapor chambers. The second recess of the first plate body itself serves as the support structure instead of the supporting copper columns of the conventional vapor chamber. This improves the shortcoming that it is impossible to dispose any supporting structure in an ultra-thin vapor chamber. Also, the straight-through structure of the present invention improves the shortcoming of the conventional vapor chamber that after the ultra-thin vapor chamber is etched to form channels, the structural strength of the vapor chamber will be insufficient. Moreover, the straight-through structure of the present invention ensures that after the ultra-thin vapor chamber is perforated, the closed chamber can still keep in the vacuumed and airtight state.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
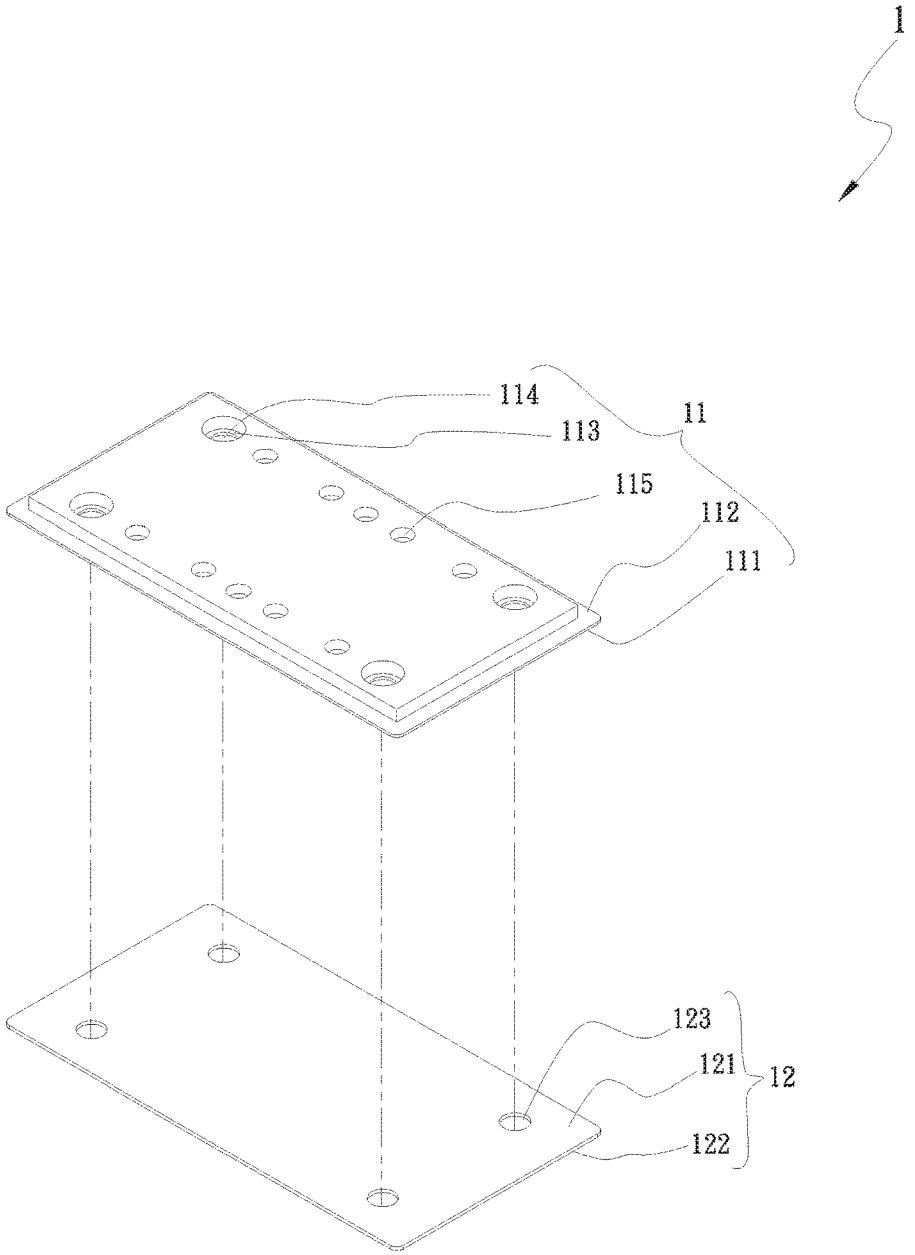
FIG. 1 is a perspective exploded view of a first embodiment of the straight-through structure of heat dissipation unit of the present invention.
Figure 2:
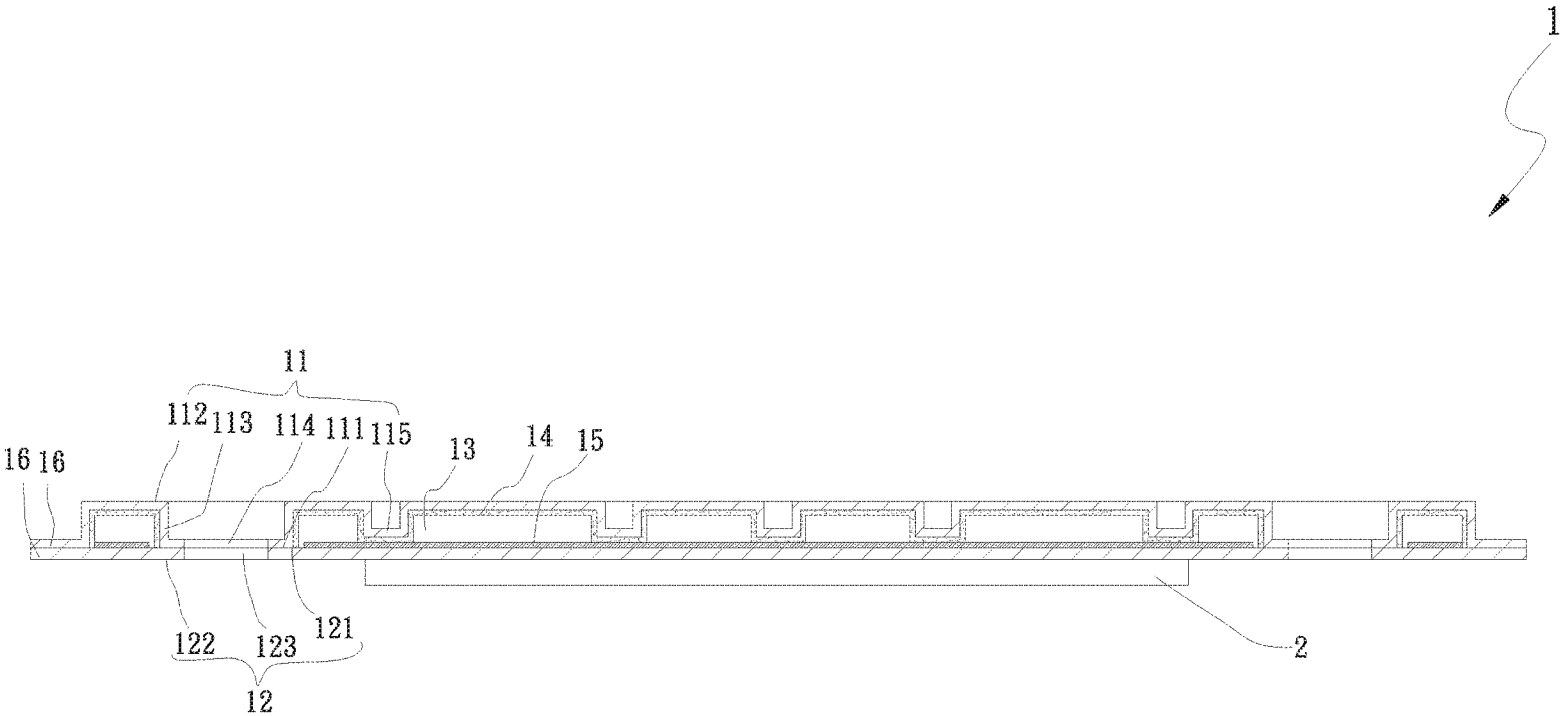
FIG. 2 is a sectional assembled view of the first embodiment of the straight-through structure of heat dissipation unit of the present invention.

Please refer to FIGS. 1 and 2. FIG. 1 is a perspective exploded view of a first embodiment of the straight-through structure of heat dissipation unit of the present invention. FIG. 2 is a sectional assembled view of the first embodiment of the straight-through structure of heat dissipation unit of the present invention. According to the first embodiment, the straight-through structure 1 of heat dissipation unit of the present invention includes a first plate body 11 and a second plate body 12.

The first plate body 11 has a first face 111, a second face 112, a first recess 113, a first perforation 114 and a second recess 115. The first and second recesses 113, 115 are recessed from the second face 112 toward the first face 111. The first perforation 114 is disposed through the first recess 113 between the first and second faces 111, 112.

The second plate body 12 has a third face 121, a fourth face 122 and a second perforation 123. The third face 121 is correspondingly mated with the first face 111, whereby the first and second plate bodies 11, 12 together define a closed chamber 13. The second perforation 123 is formed through the second plate body 12 between the third and fourth faces 121, 122 in alignment with the first perforation 114.

A hydrophilic layer 14 is disposed on the surface of the first face 111 of the first plate body 11.

A capillary structure layer 15 is disposed on the third face 121 of the second plate body 12 in the closed chamber 13. One end of the second recess 115 abuts against the capillary structure layer 15. The capillary structure layer 15 is not in contact with the first recess 113. The capillary structure layer 15 is selected from a group consisting of mesh body, fiber body and porous structure body.

A periphery of the first plate body 11 is connected with a periphery of the second plate body 12 to form a lip section 16. The lip section 16 and the first recess 113 and the third face 121 of the second plate body 12 are connected by means of diffusion bonding or welding, whereby the closed chamber 13 is sealed in a vacuumed and airtight state. The first and second perforations 114, 123 are selectively disposed at the first recess 113 or the lip section 16 so that the closed chamber 13 will not be destructed and can keep vacuumed and airtight.

The first plate body 11 serves as a section for providing condensation effect. The first plate body 11 can be connected with another heat dissipation unit to conduct the heat and enhance the condensation effect. The second plate body 12 serves as a heat absorption section and is in contact with at least one heat source 2 to conduct the heat.

Figure 3:
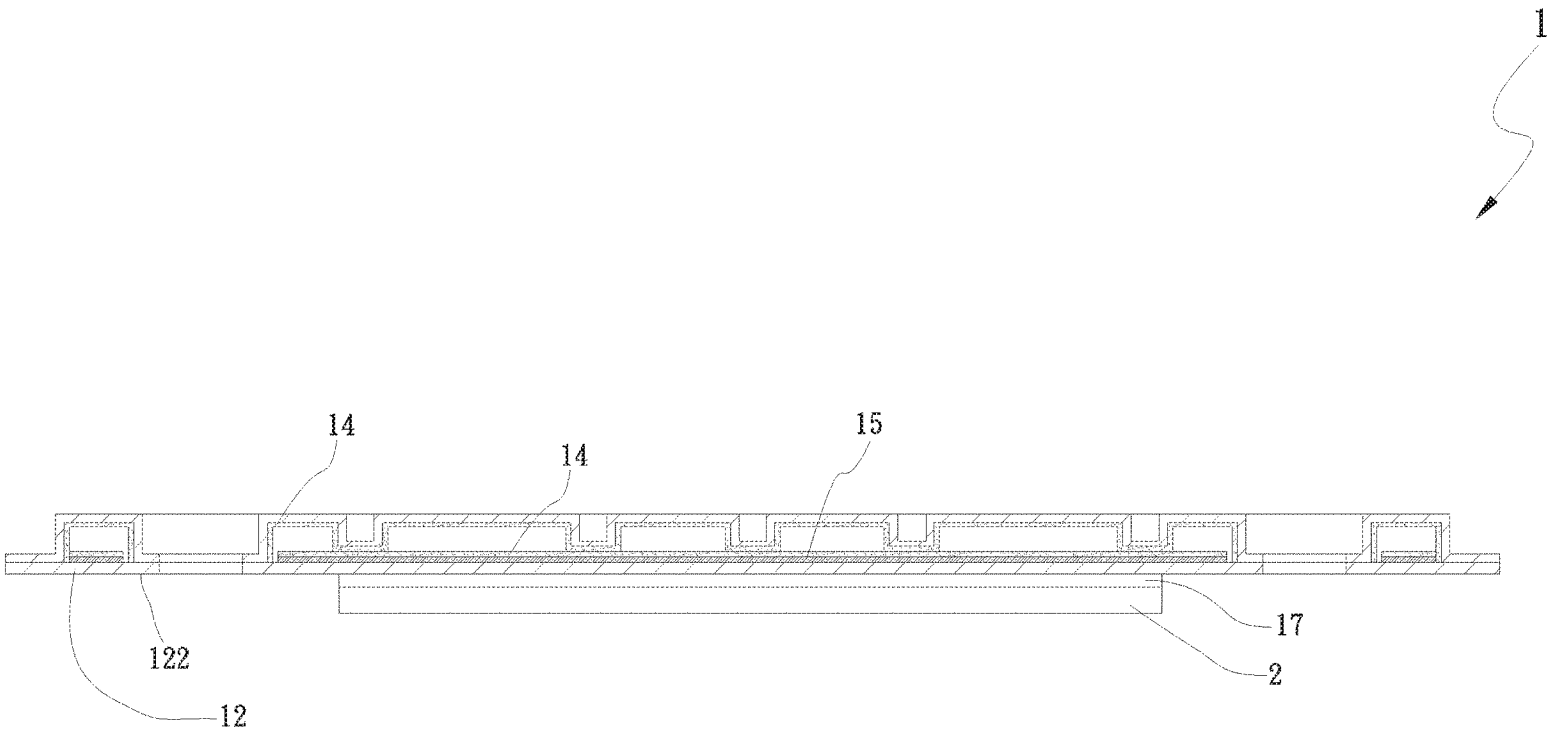
FIG. 3 is a sectional assembled view of a second embodiment of the straight-through structure of heat dissipation unit of the present invention.

Please now refer to FIG. 3, which is a sectional assembled view of a second embodiment of the straight-through structure of heat dissipation unit of the present invention. The second embodiment is partially identical to the first embodiment in structure and technical characteristic and thus will not be redundantly described hereinafter. The second embodiment is different from the first embodiment in that the hydrophilic layer 14 is disposed on the surface of the capillary structure layer 15. A heated section 17 protrudes from the fourth face 122 of the second plate body 12 in direct contact with the heat source 2. The heated section 17 can be a thick copper plate or a thin copper plate in accordance with the height of the heat source 2.

Figure 4:
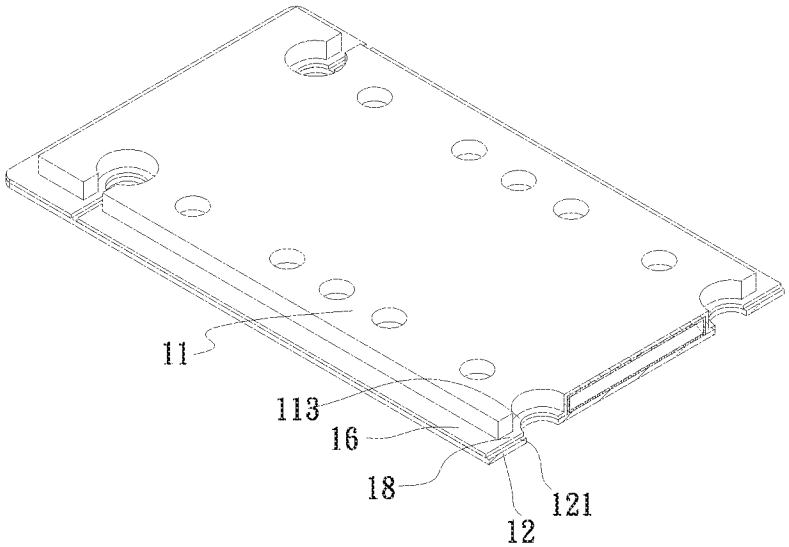
FIG. 4 is a sectional assembled view of a fourth embodiment of the straight-through structure of heat dissipation unit of the present invention.

Please now refer to FIG. 4, which is a sectional assembled view of a third embodiment of the straight-through structure of heat dissipation unit of the present invention. The third embodiment is partially identical to the first embodiment in structure and technical characteristic and thus will not be redundantly described hereinafter. The third embodiment is different from the first embodiment in that the first plate body 11 has a flange 16 and a connection section 18. The flange 16 is disposed on the periphery of the first plate body 11. Two ends of the connection section 18 are connected with the first recess 113 and the flange 16. The connection section 18 is recessed toward the third face 121 of the second plate body 12 as the first recess 113. The flange 16 and the first recess 113 and the connection section 18 are sealedly connected with the second plate body 12 by means of welding or diffusion bonding.

The capillary structure layer 15 of the first, second and third embodiments is formed by means of etching channels or sintering copper powder. The material of the mesh body is selected from the group consisting of copper, aluminum, stainless steel and titanium. The material of the first and second plate bodies 11, 12 is selected from the group consisting of copper, aluminum, stainless steel and titanium.

In the case that the mesh body is used as the capillary structure layer, the material of the mesh body is selected from the group consisting of copper, aluminum, stainless steel and titanium. Certainly, the mesh body can be alternatively a combination of laminated materials.

The primary object of the present invention is to provide a heat dissipation unit with a vacuumed and airtight chamber. When it is necessary to perforate the heat dissipation unit for fastening threaded members, the heat dissipation unit has straight-through structure for keeping the chamber in the vacuumed and airtight state. The first and second plate bodies 11, 12 are directly formed with the straight-through and connection structure (the first recess 113) and the support structure (the second recess 115) for providing supporting effect. Therefore, the ultra-thin vapor chamber has the straight-through structure, which can provide the supporting effect and keep the chamber in the vacuumed and airtight state.

The formation of the first and second recesses 113, 115 of the first plate body 11 of the present invention is not limited to any specific processing method. The first and second recesses 113, 115 of the first plate body 11 can be formed by means of punching such as embossing or stamping. Alternatively, the first and second recesses 113, 115 of the first plate body 11 can be formed by means of mechanical cutting and milling processing method or nontraditional processing method.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A straight-through structure of heat dissipation unit, comprising:

a first plate body having a first face, a second face, a first recess, a first perforation, a second recess, a flange and a connection section, the first and second recesses being recessed from the second face toward the first face, the first perforation being disposed through the first recess between the first and second faces, the flange being disposed on a periphery of the first plate body, two ends of the connection section being connected with the first recess and the flange;

a second plate body having a third face, a fourth face and a second perforation, the third face being correspondingly mated with the first face, whereby the first and second plate bodies together define a closed chamber, the second perforation being formed through the second plate body between the third and fourth faces in alignment with the first perforation;

a hydrophilic layer disposed on a surface of the first face of the first plate body; and a capillary structure layer disposed in the closed chamber, the second recess abutting against the capillary structure layer, the capillary structure layer being not in contact with the first recess.

2. The straight-through structure of heat dissipation unit as claimed in claim 1, wherein the capillary structure layer is selected from a group consisting of mesh body, fiber body and porous structure body.

3. The straight-through structure of heat dissipation unit as claimed in claim 2, wherein the material of the mesh body is selected from a group consisting of copper, aluminum, stainless steel and titanium.

4. The straight-through structure of heat dissipation unit as claimed in claim 1, wherein the material of the first and second plate bodies is selected from the group consisting of copper, aluminum, stainless steel and titanium.

5. The straight-through structure of heat dissipation unit as claimed in claim 1, wherein the connection section is recessed as the first recess.

6. The straight-through structure of heat dissipation unit as claimed in claim 1, wherein a heated section protrudes from the fourth face of the second plate body.

* * * * *